US008083077B2

(12) United States Patent
Wade et al.

(10) Patent No.: US 8,083,077 B2
(45) Date of Patent: Dec. 27, 2011

(54) DISPLAY DEVICE

(75) Inventors: Danny S. Wade, Cohutta, GA (US); Johannes Bakker, Cohutta, GA (US)

(73) Assignee: Beaulieu Group, Inc., Dalton, GA (US)

( * ) Notice: Subject to any disclaimer, the term of this patent is extended or adjusted under 35 U.S.C. 154(b) by 234 days.

(21) Appl. No.: 12/022,186

(22) Filed: Jan. 30, 2008

(65) Prior Publication Data

US 2009/0188875 A1 Jul. 30, 2009

(51) Int. Cl.
*A47F 7/16* (2006.01)

(52) U.S. Cl. ..... 211/45; 211/55; 211/85.31; 211/59.2; 211/193

(58) Field of Classification Search ..... 211/189, 211/45, 49.1, 26, 47, 196, 205, 52, 55, 94.01, 211/90.01–90.04, 95, 96, 150, 168, 59.2, 211/193, 181.1, 85.11, 36, 81, 85.31, 12, 211/85.15, 40, 41.12, 197, 72, 85.26; D6/409; 108/193, 108, 134; 434/75, 98
See application file for complete search history.

(56) References Cited

U.S. PATENT DOCUMENTS

| | | | | | |
|---|---|---|---|---|---|
| 706,929 | A | * | 8/1902 | Grimshaw | 211/45 |
| 713,636 | A | * | 11/1902 | Hasely | 211/45 |
| 869,053 | A | * | 10/1907 | Brown | 211/45 |
| 1,038,980 | A | * | 9/1912 | Snyder | 211/52 |
| 2,643,774 | A | * | 6/1953 | Patterson et al. | 211/45 |
| 3,000,113 | A | * | 9/1961 | Olson | 434/98 |
| 3,100,944 | A | * | 8/1963 | Lieberman | 434/75 |
| 3,135,058 | A | * | 6/1964 | Haas et al. | 434/75 |
| 3,138,261 | A | * | 6/1964 | Witteborg | 211/41.1 |
| 3,185,309 | A | * | 5/1965 | Radek | 211/46 |
| 3,412,485 | A | * | 11/1968 | Reigler et al. | 434/75 |
| 3,871,524 | A | | 3/1975 | Helf | |
| 3,965,583 | A | | 6/1976 | Price | |
| 4,038,767 | A | * | 8/1977 | Chasin et al. | 40/606.15 |
| 4,063,648 | A | * | 12/1977 | Fuller et al. | 211/45 |
| 4,232,791 | A | * | 11/1980 | Howard | 211/47 |
| 4,256,043 | A | * | 3/1981 | Ovitz, III | 108/29 |
| 4,331,245 | A | * | 5/1982 | Schell | 211/45 |
| 4,697,710 | A | * | 10/1987 | Gradecki et al. | 211/45 |
| 4,884,702 | A | * | 12/1989 | Rekow | 211/90.02 |
| 5,715,949 | A | * | 2/1998 | Rutledge | 211/47 |
| 5,806,688 | A | * | 9/1998 | Adenau et al. | 211/47 |
| 6,484,890 | B1 | * | 11/2002 | Miller | 211/45 |
| 6,811,046 | B2 | * | 11/2004 | Stein | 211/169 |

FOREIGN PATENT DOCUMENTS

| | | | |
|---|---|---|---|
| CA | 1117489 A1 | | 2/1982 |
| DE | 29621513 | * | 2/1997 |
| FR | 2640863 | | 6/1990 |

* cited by examiner

*Primary Examiner* — Darnell Jayne
*Assistant Examiner* — Patrick Hawn
(74) *Attorney, Agent, or Firm* — Sutherland Asbill & Brennan LLP

(57) ABSTRACT

A display device for displaying a number of samples. The display device may include a vertical member, a number of display cells with samples thereon positioned on the vertical member, and a number of hanging displays with samples thereon positioned on the vertical member.

17 Claims, 4 Drawing Sheets

DISPLAY DEVICE

TECHNICAL FIELD

The present application relates generally to a display device and more particularly relates to a carpet display device that includes one or more display cells and one or more display racks.

BACKGROUND OF THE INVENTION

Various types of carpet displays are known. For example, these known displays generally include waterfall racks in which carpet samples are arranged in a book like form. Specifically, the samples may be layered one on top of another such that the user can flip through the samples. Other types of known display devices include hanger like devices in which each sample is hung on a rack or similar structure. Many other types of display devices are known in both vertical and horizontal orientations.

These known display devices, however, face ever shrinking floor space opportunities given the popularity of other types of flooring surfaces beyond carpeting. These known display devices thus often fail to catch the eye of the consumer given the proliferation of these other surface choices. Likewise, showrooms and other types of commercial outlets may be less inclined to provide a large number of varying carpet samples for viewing given this competition for floor space.

There is a desire, therefore, for a carpet display device that can catch the eye of the consumer as well as efficiently display as many samples as possible. Such a device preferably can offer both a large number of samples and samples in different formats.

SUMMARY OF THE INVENTION

The present application thus describes an example of a display device for displaying a number of samples. The display device may include a vertical member, a number of display cells with samples thereon positioned on the vertical member, and a number of hanging displays with samples thereon positioned on the vertical member.

The display cells may include a first number of display cells with a first shape and a second number of display cells with a second shape. The display cells may include a uniform shape or a number of shapes. The display cells may include a uniform size or a number of sizes. The hanging displays may include a wire display base. A support rack with one or more sample pins may be positioned on the wire display base. The hanging displays may include a uniform size or a number of sizes. The display device further may include a footer panel, a header panel, and one or more graphics panels positioned about the vertical member.

The present application further describes an example of a display system. The display system may include a vertical member, any number of display cells positioned about the vertical member, a number of display samples positioned about the display cells, a number of hanging displays positioned about the vertical member, and any number of hanging display samples positioned about the hanging displays.

The display samples may include a number of carpet display samples and the hanging display samples may include a number of hanging carpet display samples. The display samples may include a number differing display samples and the hanging display samples may include a number of differing hanging display samples. The display cells may include a number of sizes. The hanging displays may include a number of sizes.

The present application further describes an example of a display system. The display system may include a vertical member, a number of display cells positioned about the vertical member, a number of carpet display samples positioned about the display cells, a number of hanging displays positioned about the vertical member, and a number of hanging carpet display samples positioned about the hanging displays.

These and other features of the present application will become apparent to one of ordinary skill in the art upon review of the following detailed description when taken in conjunction with the several drawings and the appended claims.

DETAILED DESCRIPTION

Figure 1:
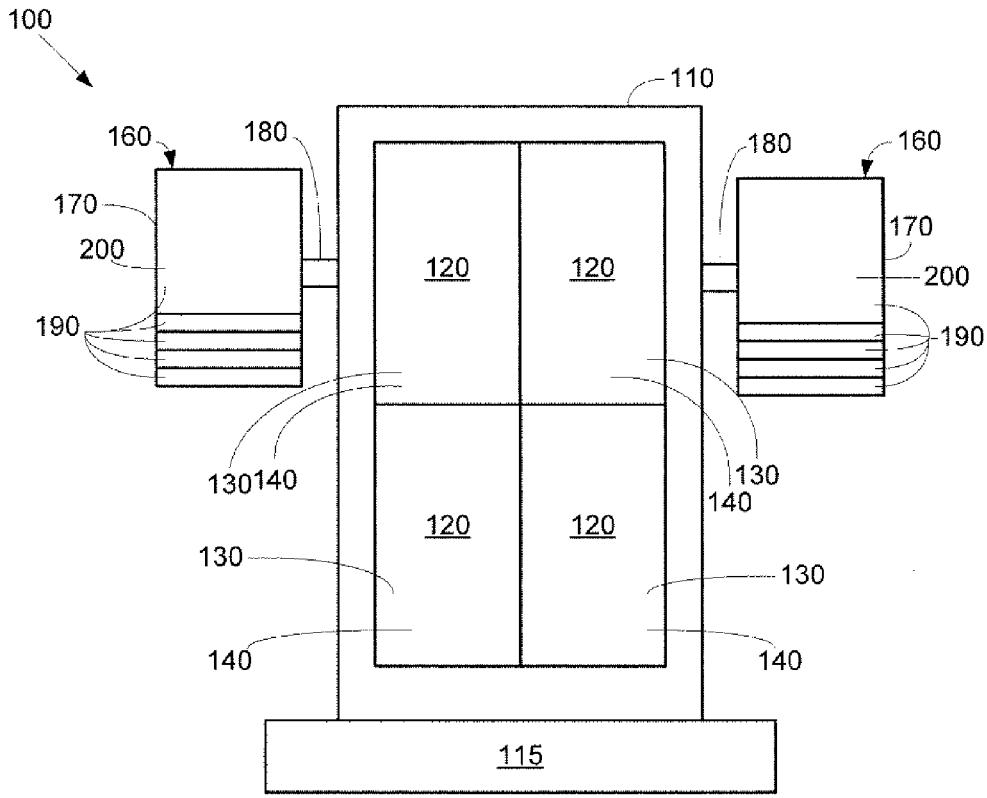
FIG. 1 is a schematic view of a display device as is described herein.
Figure 5:
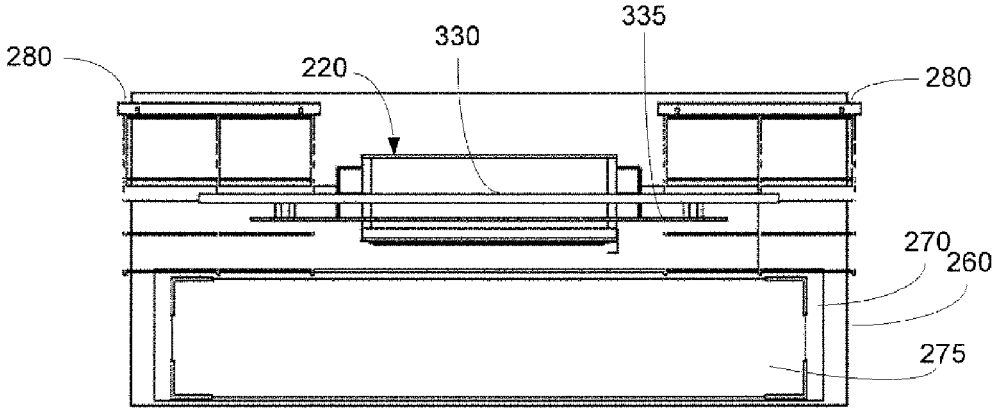
FIG. 5 is a top plan view of the display device of FIG. 2.
Figure 2:
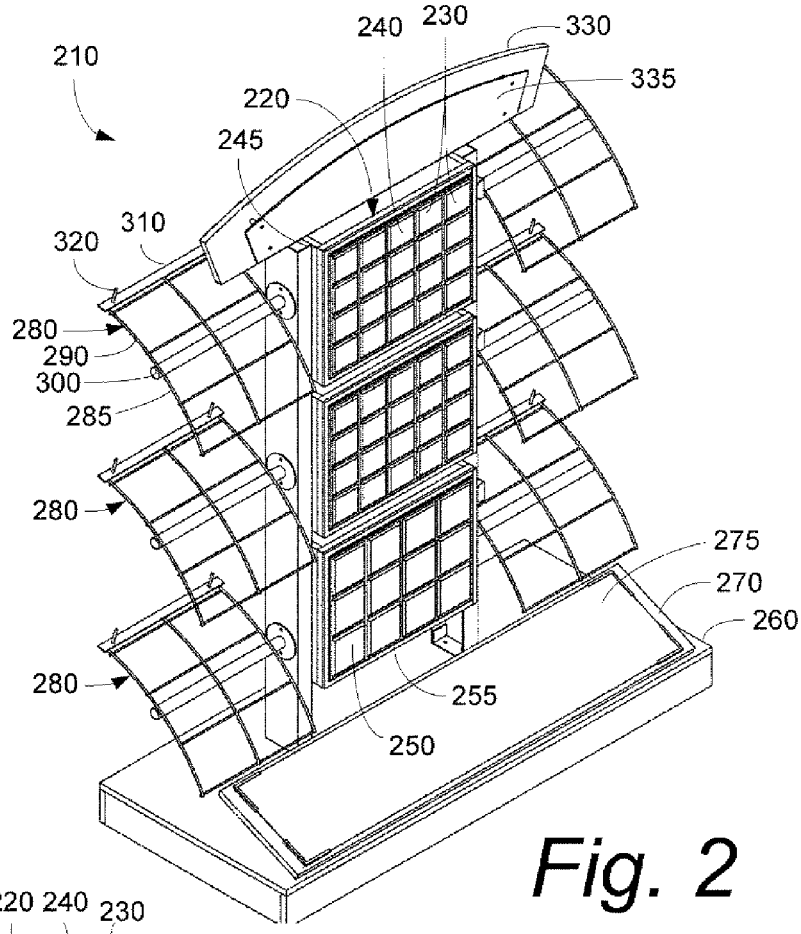
FIG. 2 is a perspective view of an alternative embodiment of a display device as is described herein.
Figure 3:
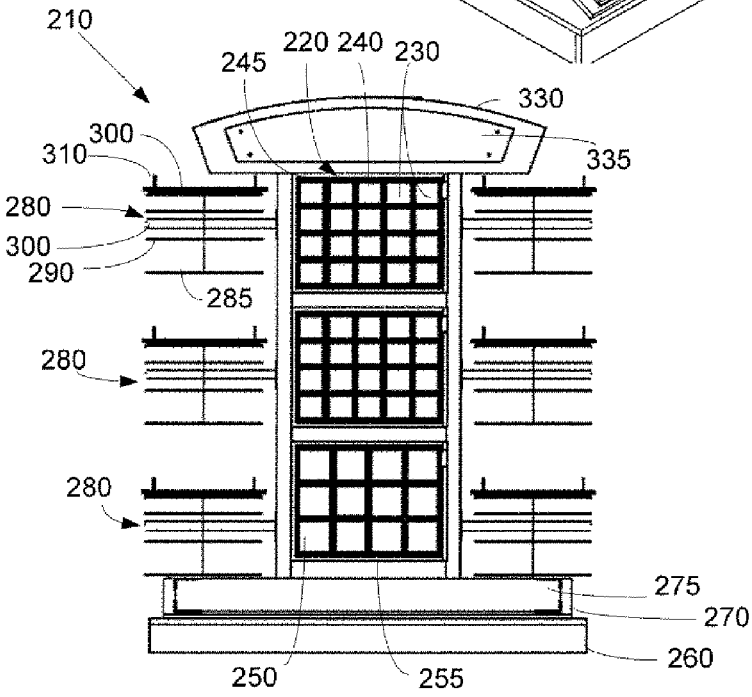
FIG. 3 is a front plan view of the display device of FIG. 2.
Figure 4:
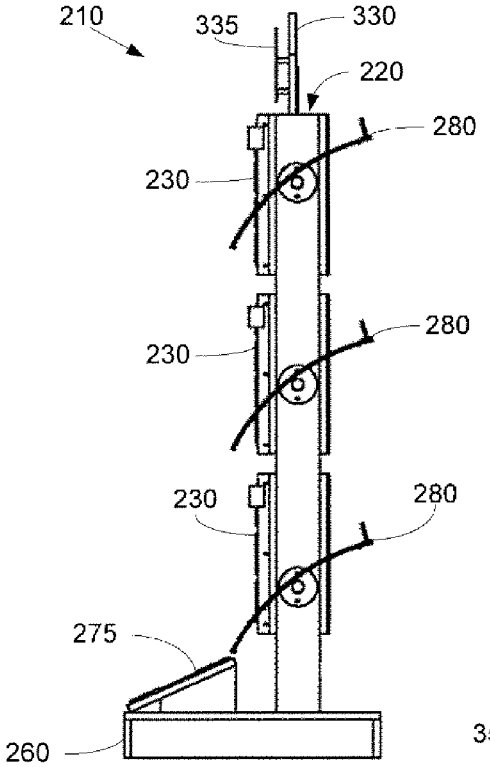
FIG. 4 is a side plan view of the display device of FIG. 2.

Referring now to the drawings, in which like numerals refer to like elements throughout the several views, FIG. 1 shows a display device 100 as is described herein. Generally described, the display device 100 may include a vertical display 110. The vertical display 110 may be a vertical member and may have any desired size, shape, or orientation. The vertical display 110 may be made out of wood, cardboard, plastics, metals, or any desired material. The vertical display 110 may be positioned on a base 115 or other type of support. The base 115 may have any desired size, shape, or orientation.

The vertical display 110 may have a number of display cells 120 positioned thereon or therein. Any number, shape, size, or orientation of the display cells 120 may be used. The display cells 120 may be positioned on one or both sides of the vertical display 110. The display cells 120 may be raised from the vertical display 110, may be positioned within the vertical display 110, or may be otherwise positioned. The display cells 120 may be made out of styrene, wood, cardboard, plastics, metals, or any other desired material. A number of display samples 130 may be positioned within the display cells 120. The display samples 130 may be in the form of a carpeting sample 140 or any type of material that is desired to be displayed. The display samples 130 may be different, may be the same, may be arranged so as to form a design or pattern, or any desired combination thereof. The display samples 130 may be attached to the display cells 120 by adhesives, staples, Velcro, or any desired means of attachment.

The display device 100 may include one or more hanging displays 160. The hanging displays 160 may be attached to the side or sides of the vertical display 110. Each hanging display 160 may include a display base 170 attached to the vertical display 110 via a rod 180 or a similar type of structure. The hanging displays 160 may take any desired size, shape, or orientation. Any number of hanging displays 160 may be used. The hanging displays 160 may be made out of metals, plastics, wood, or any type of desired material. A number of hanging samples 190 may be positioned on the hanging display 160. The hanging samples 190 may be in the form of a hanging carpet sample 200 or any type of material that is desired to be displayed. Any number of hanging samples 190 may be used. The hanging samples 190 may be the same or different.

FIGS. 2-5 show an alternative embodiment of a display device 210. The display device 210 also may include a vertical display 220 with a number of display cells 230 thereon. In this example, the vertical display 220 has a number of display cells 230 in a first size 240 and a number of display cells 230 in a second size 250. Specifically, there are two (2) panels 245 with twenty (20) display cells 230 of the first size 240 and one (1) panel 255 with twelve (12) display cells 230 of the second size 250. Any number of display cells 230 and/or panels 245, 255 may be used in any size, shape, or orientation.

Any number of the display samples 130 may be positioned within the display cells 230. The display samples 130 may be a number of the carpet samples 140 or other items.

The vertical display 110 may be positioned on a base 260. The base 260 may have any desired size, shape, or orientation. The base 260 may include a footer panel 270 thereon. The footer panel 270 may have any desired size, shape, or orientation. In this example, the footer panel 270 is positioned at an angle from the base 260. The footer panel 270 may have one or more graphics panels 275 thereon. The graphics panels 275 may include decorations, communications, or other types of information in any format or media.

The display device 210 also includes a number of hanging displays 280 thereon. The hanging displays 280 may be positioned on the side or sides of the vertical display 220. In this example, six (6) hanging displays 280 are used. Any number of hanging displays 280 may be used in any size, shape, or orientation. Each hanging display 280 may include a display base 290 attached to the vertical display 220 via a rod 300 or a similar type of structure. The hanging displays 280 may be in the form of a number of connected wires 285 as is shown or in any desired configuration. Each hanging display 280 also may have a sample rack bar 310 on one end thereof. Each sample rack bar 310 may have a number of pins 320 extending therefrom.

The hanging display samples 190, including the hanging carpet samples 200, may be positioned on the display base 290 and held in place via the pins 320 of the sample rack bar 310. Other types of attachment means may be used herein to secure the hanging display samples 190 to the hanging displays 280. Any number of hanging samples 190 may be used.

The display device 210 also may include a header panel 330 positioned on top of the vertical display 220. The header panel 330 may have any desired size, shape, or orientation. The header panel 330 may have one or more graphics panels 335 thereon. The graphics panels 335 may include decorations, communications, or other types of information in any format or media.

Figure 6:
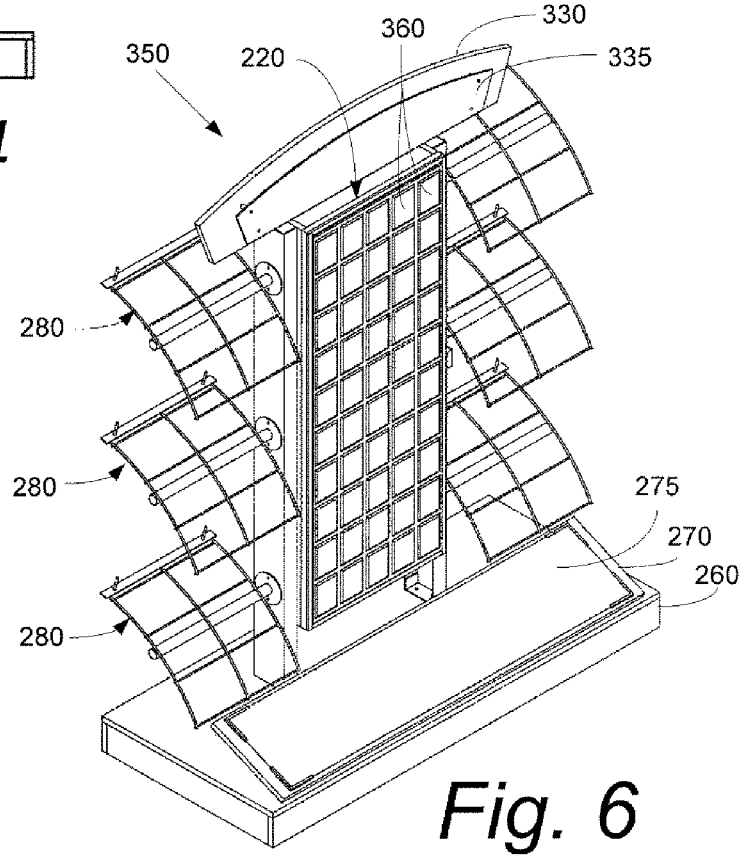
FIG. 6 is a perspective view of a further alternative embodiment of a display device as is described herein.

FIG. 6 shows a further alternative embodiment of a display device 350 as is described herein. The display device 350 may include the vertical display 220, the base 260 with the footer panel 270 and the graphics panel 275, the hanging displays 280, and the header panel 230 with the graphics panel 235. Other configurations also may be used herein as described above or similar to those described above.

In this embodiment, however, the vertical display 220 may include a number of uniformly sized and shaped display cells 360 positioned thereon. Specifically, fifty (50) display cells 360 are shown. Any number of the display cells 360 may be used in any size, shape, or orientation. Any number of the display samples 130 may be positioned within the display cells 360. The display samples 130 may include a number of the carpet samples 140 or other items.

Figure 7:
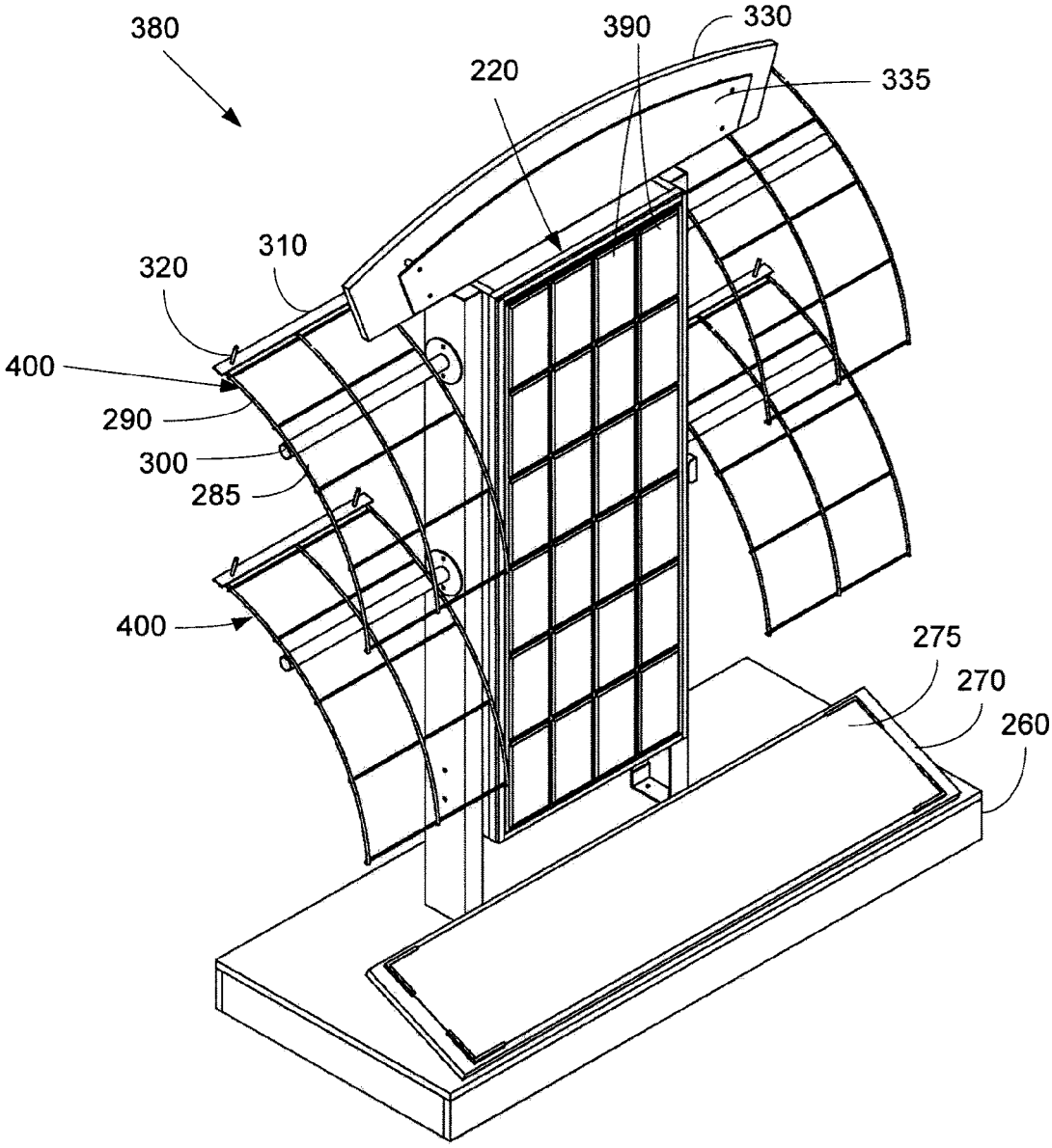
FIG. 7 is a perspective view of a further alternative embodiment of a display device as is described herein.

FIG. 7 shows a further alternative embodiment of a display device 380 as is described herein. The display device 380 may include the vertical display 220, the base 260 with the footer panel 270 and the graphics panel 275, and the header panel 230 with the graphics panel 335. Other configurations also may be used herein as described above or similar to those described above.

In this embodiment, however, the vertical display 220 may include a number of uniformly sized and shaped display cells 390 positioned thereon. Specifically, twenty-four (24) display cells 390 are shown. Any number of the display cells 390 may be used in any size, shape, or orientation. Any number of the display samples 130 may be positioned within the display cells 360. The display samples 130 may include a number of the carpet samples 140 or other items.

The display device 380 also may include a number of hanging displays 400. The hanging displays 400 may be similar in design to the hanging displays 280 described above, but somewhat larger in size such that only four (4) hanging displays 400 are used herein. Any number of hanging displays 400 may be used in any size, shape, or orientation. The hanging display samples 190, including the hanging carpet samples 200, may be positioned on the hanging displays 400. Differently sized hanging displays also may be used.

As is shown, the display devices 100, 210, 350, 380 may have the display cells 120, 230, 360, 390 and the hanging displays 160, 280, 400 in any number, size, shape, or orientation. Rather, the display devices 100, 210, 350, 380 serve to catch the eye of the consumer based upon the combination of the display cells 120, 230, 360, 390 and the hanging displays 160, 280, 400 in any form. The display devices 100, 210, 350, 380 thus provide the ability to display a large number of samples 130, 140, 190, 200 in different configurations and in a space efficient manner.

It should be apparent that the foregoing relates only to certain embodiments of the present application and that numerous changes and modifications may be made herein by one of ordinary skill in the art without departing from the general spirit and scope of the invention as defined by the following claims and the equivalents thereof.

We claim:

1. A display device, comprising:

a vertical member;

a plurality of carpet display cells positioned on a front of the vertical member in a first direction, with a plurality of samples affixed to the display cells; and a plurality of curved waterfall displays affixed at a central portion of the length of the curved waterfall displays to one or more lateral sides of the vertical member via a cantilevered rod extending outward from the one or more lateral sides of the vertical member in a second direction substantially perpendicularly to the first direction; and wherein the plurality of curved waterfall displays comprises a support rack with one or more sample pins so as to hang a plurality of layered carpet samples thereon.

2. The display device of claim 1, wherein the plurality of display cells comprises a first plurality of display cells comprising a first shape and a second plurality of display cells comprising a second shape.

3. The display device of claim 1, wherein the plurality of display cells comprises a uniform shape.

4. The display device of claim 1, wherein the plurality of display cells comprises a plurality of shapes.

5. The display device of claim 1, wherein the plurality of display cells comprises a uniform size.

6. The display device of claim 1, wherein the plurality of display cells comprises a plurality of sizes.

7. The display device of claim 1, wherein the plurality of curved waterfall displays comprises a wire display base with the plurality of layered samples supported thereon.

8. The display device of claim 1, wherein the plurality of curved waterfall displays comprises a uniform size.

9. The display device of claim 1, wherein the plurality of curved waterfall displays comprises a plurality of sizes.

10. The display device of claim 1, further comprising a footer panel positioned about the vertical member.

11. The display device of claim 1, further comprising a header panel positioned about the vertical member.

12. The display device of claim 1, further comprising one or more graphics panels positioned about the vertical member.

13. A display system, comprising:

a vertical member;

a plurality of carpet display cells positioned on a front of the vertical member in a first direction;

a plurality of carpet display samples affixed to the plurality of display cells;

a plurality of curved waterfall displays affixed at a central portion of the length of the curved waterfall displays to one or more lateral sides of the vertical member via a cantilevered rod extending outward from the one or more lateral sides of the vertical member in a second direction substantially perpendicularly to the first direction; and a plurality of layered carpet display samples positioned about the plurality of curved waterfall displays;

wherein the plurality of curved waterfall displays comprises a support rack with one or more sample pins so as to hang a plurality of layered carpet display samples thereon.

14. The display system of claim 13, wherein the plurality of display samples comprises a plurality of differing display samples and wherein the plurality of layered display samples comprises a plurality of differing layered display samples.

15. The display system of claim 13, wherein the plurality of display cells comprises a plurality of sizes.

16. The display system of claim 13, wherein the plurality of curved waterfall displays comprises a plurality of sizes.

17. A display system, comprising:

a vertical member;

a plurality of display cells positioned on a front of the vertical member in a first direction;

a plurality of carpet display samples affixed to the plurality of display cells;

a plurality of curved waterfall displays affixed at a central portion of the length of the curved waterfall displays to one or more lateral sides of the vertical member via a cantilevered rod extending outward from the one or more lateral sides of the vertical member in a second direction substantially perpendicularly to the first direction; and a plurality of layered carpet display samples positioned about the plurality of curved waterfall displays;

wherein the plurality of curved waterfall displays comprises a support rack with one or more sample pins so as to hang the plurality of layered carpet samples thereon.

* * * * *